US009485574B2

(12) United States Patent
Sun et al.

(10) Patent No.: US 9,485,574 B2
(45) **Date of Patent: *Nov. 1, 2016**

(54) SPATIAL INTERFERENCE SUPPRESSION USING DUAL-MICROPHONE ARRAYS

(71) Applicant: Cisco Technology, Inc., San Jose, CA (US)

(72) Inventors: Haohai Sun, Sandvika (NO); Espen Moberg, Oslo (NO)

(73) Assignee: Cisco Technology, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/934,409

(22) Filed: Nov. 6, 2015

(65) Prior Publication Data

US 2016/0066092 A1 Mar. 3, 2016

Related U.S. Application Data

(63) Continuation of application No. 13/713,357, filed on Dec. 13, 2012, now Pat. No. 9,210,499.

(51) Int. Cl.

| | |
|---|---|
| ***H04R 3/00*** | (2006.01) |
| ***H04R 1/32*** | (2006.01) |
| ***H04R 1/40*** | (2006.01) |

(52) U.S. Cl.

CPC ..... *H04R 3/005* (2013.01); *H04R 1/326* (2013.01); *H04R 1/406* (2013.01); *H04R 2430/25* (2013.01)

(58) Field of Classification Search

None

See application file for complete search history.

(56) References Cited

U.S. PATENT DOCUMENTS

| | | | | |
|---|---|---|---|---|
| 2005/0249361 | A1 | 11/2005 | Beavis et al. | |
| 2008/0167869 | A1 | 7/2008 | Nakadai et al. | |
| 2011/0038489 | A1 | 2/2011 | Visser et al. | |
| 2011/0096206 | A1* | 4/2011 | Okazaki | H04R 3/005 348/241 |
| 2012/0020485 | A1* | 1/2012 | Visser | H04R 3/005 381/57 |
| 2014/0169576 | A1 | 6/2014 | Sun et al. | |
| 2015/0156598 | A1 | 6/2015 | Sun et al. | |

FOREIGN PATENT DOCUMENTS

| | | |
|---|---|---|
| EP | 1818909 | 8/2007 |

OTHER PUBLICATIONS

Buck et al., A Compact Microphone Array System with Spatial Post-Filtering for Automotive Applications, 2009, pp. 221-224, ICASSP.

(Continued)

*Primary Examiner* — Regina N Holder

(74) *Attorney, Agent, or Firm* — Lempia Summerfield Katz LLC

(57) ABSTRACT

Systems, processes, devices, apparatuses, algorithms and computer readable medium for suppressing spatial interference using a dual microphone array for receiving, from a first microphone and a second microphone that are separated by a predefined distance, and that are configured to receive source signals, respective first and second microphone signals based on received source signals. A phase difference between the first and the second microphone signals is calculated based on the predefined distance. An angular distance between directions of arrival of the source signals and a desired capture direction is calculated based on the phase difference. Directional-filter coefficients are calculated based on the angular distance. Undesired source signals are filtered from an output based on the directional-filter coefficients.

20 Claims, 7 Drawing Sheets

(56) References Cited

OTHER PUBLICATIONS

Buck, Aspects of First-Order Differential Microphone Arrays in the Presence of Sensor Imperfections, 2002, pp. 115-122, vol. 13, Eur. Trans. Telecomm.
Elko et al., A Steelable and Variable First-Order Differential Microphone Array, 1997, pp. 223-226, vol. 1, ICASSP.
International Search Report and Written Opinion cited in PCT/US2013/074727, mailed Apr. 23, 2014.
Kerner et al., Two Microphone Array MVDR Beamforming with Controlled Beamwidth and Immunity to Gain Mismatch, Sep. 2012, pp. 1-4, IWAENC.
Sun et al., Robust Minimum Sidelobe Beamforming for Spherical Microphone Arrays, 2011, pp. 1045-1051, vol. 19, IEEE Trans Audio Speech Lang Proc.
Sun et al., Worst-Case Performance Optimization for Spherical Microphone Array Modal Beamformers, 2011, pp. 31-35, HSCMA.
Teutsch et al., An Adaptive Close-Talking Microphone Array, 2001, pp. 163-166, IEEE WASPAA.
Teutsch et al., First-and Second-Order Adaptive Differential Microphone Arrays, 2001, pp. 35-38, IWAENC.
Tiergart et al., Localization of Sound Sources in Reverberant Environments Based on Directional Audio Coding Parameters, Paper 7853, 2009, 127th AES Conventions, New York.

* cited by examiner

SPATIAL INTERFERENCE SUPPRESSION USING DUAL-MICROPHONE ARRAYS

CROSS-REFERENCE TO RELATED APPLICATIONS

This application is a continuation under 37 C.F.R. §1.53 (b) and 35 U.S.C. §120 of U.S. patent application Ser. No. 13/713,357 filed Dec. 13, 2012, the disclosure of which is incorporated herein by reference in its entirety.

BACKGROUND

In a personal telepresence system or speech communication system, a voice/audio signal can be captured by one omnidirectional microphone. When the environment is noisy, the omnidirectional microphone picks up not only desired voices, but also interferences in the environment, which may lead to impaired voice quality and a low quality user experience.

SUMMARY

Systems, processes, devices, apparatuses, algorithms and computer readable medium for suppressing spatial interference can use a dual microphone array for receiving, from a first microphone and a second microphone that are separated by a predefined distance, and that can be configured to receive source signals, respective first and second microphone signals based on received source signals. A phase difference between the first and the second microphone signals can be calculated based on the predefined distance. Angular distances between directions of arrivals (DOAs) of the source signals and the desired capture direction can be calculated based on the phase difference. Directional-filter coefficients can be calculated based on the angular distance. Undesired source signals can be filtered from an output based on the directional-filter coefficients.

A device can include a first microphone and a second microphone that can be separated by a predefined distance, and that can be configured to receive source signals and output respective first and second microphone signals based on received source signals. A signal processor of the device can be configured to: calculate a phase difference between the first and the second microphone signals based on the predefined distance, calculate an angular distance between directions of arrival of the source signals and a desired capture direction based on the phase difference; and calculate directional-filter coefficients based on the angular distance. The signal processor can filter undesired source signals from an output of the signal processor based on the directional-filter coefficients.

The signal processor can be configured to calculate the phase difference by calculating phase differences, between the first and second microphone signals, for a particular short-time frame, across a plurality of discrete subbands of the first and second microphone signals. The signal processor can be configured to calculate the angular distance by calculating angular distances, for a particular short-time frame, across a plurality of discrete subbands of the first and second microphone signals, by applying a trigonometric function to phase differences calculated by the signal processor. The signal processor can be configured to calculate direction-filter coefficients, for a particular short-time frame, across a plurality of discrete subbands of the first and second microphone signals, by applying a trigonometric function to angular distances calculated by the signal processor.

The signal processor can be configured to replace each of the directional-filter coefficients of a first range of subbands with an average value of the directional-filter coefficients for a second range of subbands. The first range of frequency subbands can correspond with 80~400 Hz, and the second range of frequency subbands can correspond with 2~3 kHz.

The signal processor can be configured to calculate a global gain using an average of relatively robust subband directional-filter coefficients, and can apply this average as the global to all the calculated subband directional-filter coefficients. The relatively robust subband directional-filter coefficients can correspond with 1~7 kHz.

The first and the second microphones can be omnidirectional microphones, and the predefined distance can be between 0.5 and 50 cm. The predefined distance can be about 2 cm, and can be 1.7 cm.

The signal processor can be configured to process the first and second microphone signals according to the following equations: $X_1(n,k)=S_1(n,k)\cdot\exp(j\phi_1)+V_1(n,k)$, and $X_2(n,k)=S_2(n,k)\cdot\exp(j\phi_2)+V_2(n,k)$. Here, n denotes a short-time frame, k denotes a subband, and $X_{1.2}$, $S_{1.2}$, $V_{1.2}$ and $\phi_{1.2}$ denote, respectively, the microphone signals, signal amplitudes, noise, and phases of the first and second microphone signals. The signal processor can also be configured to calculate the phase difference according to the following equation: $\Delta\phi(n,k)=\text{atan2}\{\text{Im}[X_1(n,k)], \text{Re}[X_1(n,k)]\}-\text{atan2}\{\text{Im}[X_2(n,k)], \text{Re}[X_2(n,k)]\}$.

The signal processor can be configured to calculate the angular difference according to the following equation:

$$\Delta\theta(n,k) \approx \frac{\Delta\varphi(n,k)\cdot c}{2\pi\cdot f_k\cdot d}.$$

The signal processor can be configured to calculate the directional-filter coefficients according to the following equation: $G(n,k)=\{0.5+0.5\cdot\cos[\beta\cdot\Delta\theta(n,k)]\}^{\alpha}$. Here, G(n,k) denotes the directional coefficient for frame n and subband k, β is a parameter for beamwidth control, and α is a suppression factor.

The signal processor can be configured to improve low-frequency robustness of the calculate directional coefficients by replacing the directional-filter coefficients of a first range of subbands with an average value of the directional-filter coefficients for a second range of subbands. Here, the second range of subbands can include a range of frequencies that are higher than that of the first range of subbands, and the replacing can be in accordance with the following equation: $G(n,k_{80\sim400\ Hz})=\overline{G(n,k_{2\sim3kHz})}$.

The signal processor can be configured to reduce spatial aliasing by calculating a global gain using an average of relatively robust subband directional-filter coefficients, and applying this average as the global to all the calculated subband directional-filter coefficients. Here, the relatively robust subband directional-filter coefficients can correspond with 1~7 kHz.

A device can also include a first microphone and a second microphone that are separated by a predefined distance, and that are configured to receive source signals and output respective first and second microphone signals based on received source signals. Signal processing means can perform: calculating a phase difference between the first and the second microphone signals based on the predefined distance, calculating an angular distance between directions of arrival of the source signals and a desired capture direction based on the phase difference, and calculating directional-filter coefficients based on the angular distance. The signal processing means can filter undesired source signals from an output thereof based on the directional-filter coefficients.

A method can include receiving, from a first microphone and a second microphone that are separated by a predefined distance, and that are configured to receive source signals, respective first and second microphone signals based on received source signals. A phase difference between the first and the second microphone signals can be calculated based on the predefined distance. An angular distance between directions of arrival of the source signals and a desired capture direction can be calculated based on the phase difference. Directional-filter coefficients can be calculated based on the angular distance. Undesired source signals can be filtered from an output based on the directional-filter coefficients. One or more non-transitory computer readable storage mediums encoded with software comprising computer executable instructions, which when executed by one or more processors, can execute this method.

The foregoing paragraphs have been provided by way of general introduction. The described embodiments, together with the attendant advantages thereof, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
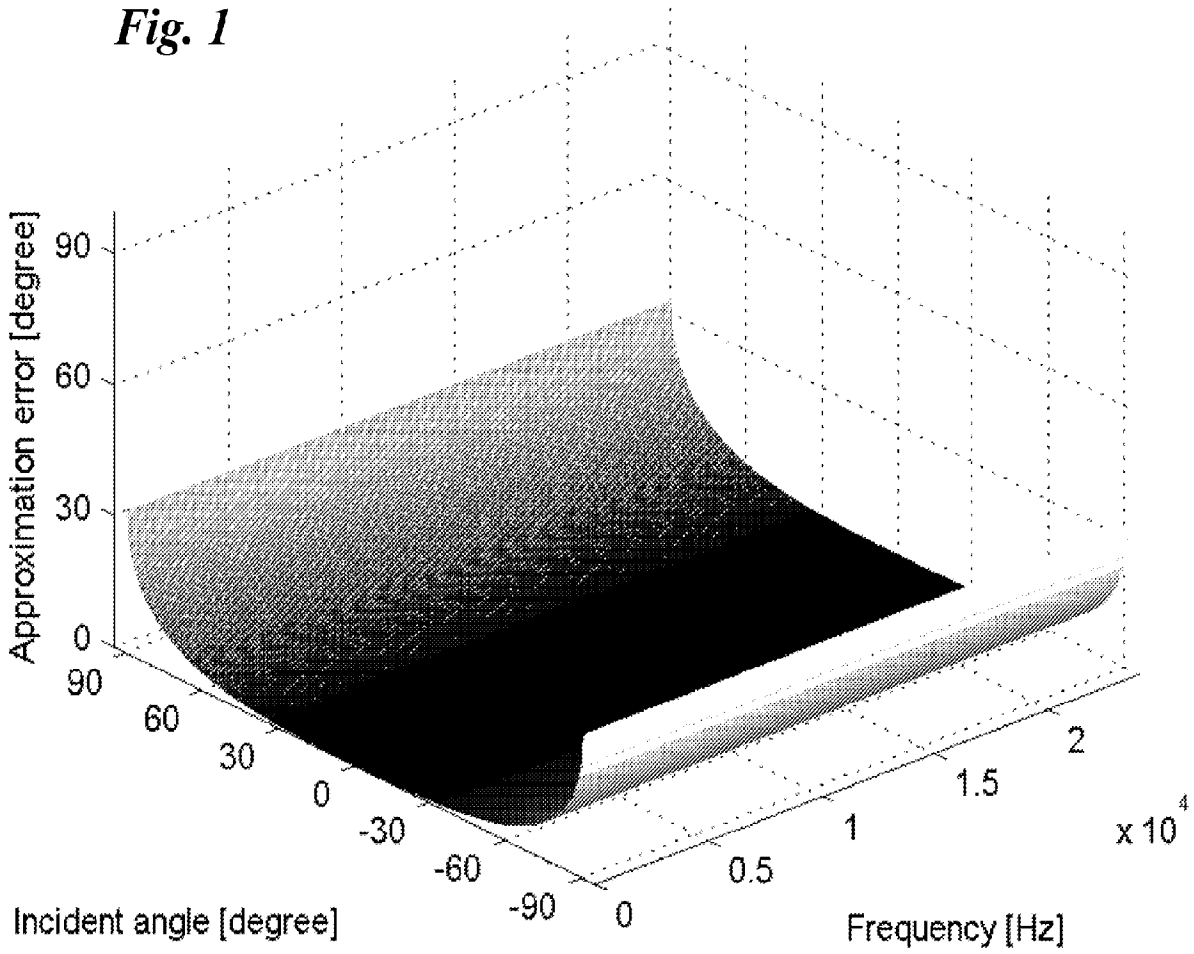
FIG. 1 illustrates an approximation error as a function of incident angle and frequency.

In the drawings, like reference numerals/identifiers designate identical or corresponding parts throughout the several views. Further, the use singular terms, such as "a," "an," and the like, carry the meaning of "one or more," unless expressly stated otherwise.

The following is a listing of references referred to in this application.

[1] M. S. Brandstein and D. Ward eds., *Microphone Arrays: Signal Processing Techniques and Applications*, Springer, Berlin, Germany, 2001.

[2] G. W. Elko and A. T. N. Pong, "A steerable and variable first-order differential microphone array," in *Proc. ICASSP* 1997, vol. 1, pp. 223-226, 1997.

[3] H. Teutsch and G. W. Elko, "An adaptive close-talking microphone array," in *Proc. IEEE WASPAA*, pp. 163-166, 2001.

[4] H. Teutsch and G. W. Elko, "First- and second-order adaptive differential microphone arrays," in *Proc. IWAENC* 2001, pp. 35-38, 2001.

[5] M. Buck, "Aspects of first-order differential microphone arrays in the presence of sensor imperfections," *Eur. Trans. Telecomm.*, vol. 13, pp. 115-122, 2002.

[6] M. Buck, T. Wolff, T. Haulick, and G. Schmidt, "A compact microphone array system with spatial post-filtering for automotive applications," in *Proc. ICASSP* 2009, pp. 221-224, 2009.

[7] Y. Kerner and H. Lau, "Two microphone array MVDR beamforming with controlled beamwidth and immunity to gain mismatch," *Proc. IWAENC* 2012, pp. 1-4, September 2012.

[8] H. Sun, S. Yan, and U. P. Svensson, "Robust Minimum Sidelobe Beamforming for Spherical Microphone Arrays," *IEEE Trans Audio Speech Lang Proc*, vol. 19, pp. 1045-1051, 2011.

[9] H. Sun, S. Yan, and U. P. Svensson, "Worst-case performance optimization for spherical microphone array modal beamformers," in *Proc. of HSCMA* 2011, pp. 31-35, 2011.

[10] O. Tiergart, et al., "Localization of Sound Sources in Reverberant Environments Based on Directional Audio Coding Parameters," in 127*th AES Convention*, Paper 7853, New York, USA, 2009.

A single directional microphone can suppress some environmental interferences. However, the suppression performance is very limited, and it can be difficult to integrate a directional microphone in some systems, such as a laptop computer. Further, such systems can be inherently sensitive to mechanical vibrations.

In a conventional system, a microphone array combined with beamforming algorithms can be utilized, as in document [1]. Microphone array beamformers weight and sum all signals from the microphones, and apply post-filtering techniques to form a spatial beam that can extract the desired voices coming from the desired direction, and at the same time, suppress the spatial interferences coming from other directions.

In personal and mobile voice communication devices, it is desired to have compact microphone arrays with few microphones to achieve directional filtering. Therefore, there have been many studies on compact dual-microphone array beamforming techniques. See, e.g., documents [2]-[6]. These documents discuss differential array beamforming (see documents [2]-[5]), superdirectional beamforming (see document [1]), adaptive beamforming (see document [4]), and adaptive beamforming and post filtering (see document [6]).

A dual-microphone array can be implemented in a laptop, such as a ThinkPad W510, which is manufactured by Lenovo (Registered Mark) (Lenovo Group Limited). The ThinkPad W510 includes a dual-microphone array with an audio signal processor provided by Conexant Systems, Inc. An algorithm for the audio signal processor, a dual-microphone array beamforming technique, is presented in document [7].

A traditional dual microphone array beamforming technique can suffer the following drawbacks. There may be high computational complexity or relatively long convergence time, when dealing with broad band audio signals. Beamforming performance and voice quality can degrade when there are microphone deviations (microphone sensitivity/phase mismatch). There can be either microphone self-noise amplification or cut-off at low frequencies. Conventionally, microphone calibration or robust algorithm design are required (see, e.g., documents [5] and [7]-[9]), which may further increase algorithm complexity.

Prior and conventional efforts concentrate on advanced signal models, more optimal array geometries, and more complicated, but intelligent, algorithms to achieve better array processing performance. In the following discussion, an implementation of a simplified signal model, a small microphone array consisting of only two omnidirectional elements, and a low-complexity interference suppression algorithm is described to provide a easy-to-implement and high-performance solution for practical speech communication devices.

Low-Complexity Spatial Interference Suppressor

An algorithm is operated in a short-time frequency domain. For each short-time frame and frequency subband, dual-microphone phase differences are estimated and angular distances between directions of arrival (DOAs) of source signals and the desired capture direction are calculated in a simple, but effective way. Then, the directional-filter coefficients are computed based on the angular distance information, and are applied to the output of the microphone signal processing module, preserving the sound from the desired direction and attenuating the sound from other directions. This directional filtering concept is similar to conventional beamforming methods, but it can be designed and implemented in an efficient measure, given the following signal-model assumption.

In a room acoustic environment, two captured time-domain microphone signals, comprising both the sound from the desired sources and other interfering sounds from other directions (the sound from undesired sources, early reflections, and sensor noise), are decomposed into short-time frequency subbands using analysis filter banks. In order to design an efficient and practical interference suppression algorithm, all of the source signals are assumed to be W-disjoint orthogonal (WDO) for each short-time subband. That is, signals do not overlap for most of the short-time subbands. This assumption is simple, but is reasonable for frequency-domain instantaneous speech mixtures, even in a reverberant environment as described in document [10].

Based on the simplified signal model mentioned above, the microphone signals in short-time frame n and subband k, which can consist of one major source signal and noise, can be written as:

$$X_1(n,k)=S_1(n,k)\cdot\exp(j\phi_1)+V_1(n,k), \tag{1}$$

$$X_2(n,k)=S_2(n,k)\cdot\exp(j\phi_2)+V_2(n,k), \tag{2}$$

where $X_{1.2}$, $S_{1.2}$, $V_{1.2}$ and $\phi_{1.2}$ denote the captured microphone signals, signal amplitudes, noise, and phases of the captured signals at the first and the second microphones, respectively.

When the signal to noise ratio in frame n and subband k is sufficiently high, the phase difference between two microphone channels, $\Delta\phi(n,k)$, can be simply estimated by $$\Delta\phi(n,k)=\text{atan 2}\{Im[X_1(n,k)],Re[X_1(n,k)]\}-\text{atan 2}\{Im[X_2(n,k)],Re[X_2(n,k)]\}. \tag{3}$$

Then, the angular distance $\Delta\theta(n,k)$ between source DOAs and the desired direction $\theta_0$ are calculated using a triangular property:

$$\Delta\theta(n,k)=\arcsin\left[\frac{\Delta\varphi(n,k)\cdot c}{2\pi\cdot f_k\cdot d}\right]-\theta_0, \tag{4}$$

where c is the speed of sound, $f_k$ is the center frequency of subband k, and d is the distance between two microphones.

In speech communication devices (laptops, telepresence systems, etc.), dual-microphone arrays can be placed in a broadside style with front direction ($\theta_0$=0) as the desired direction. In this case, the estimation of the angular distance (4) can be further simplified as:

$$\Delta\theta(n,k)\approx\frac{\Delta\varphi(n,k)\cdot c}{2\pi\cdot f_k\cdot d}. \tag{5}$$

When the signals incident angle is close to zero (in front), which should be preserved, this approximated solution could estimate $\Delta\theta(n,k)$ fairly precisely, due to the fact that arcsin $(\theta)\approx\theta$, if the incident angle $\theta$ is close to zero. When signals arrive from out-beam directions, the estimating bias for $\Delta\theta(n,k)$ increases. However, since all out-beam signals should be suppressed, precise DOA estimations for these out-beam signals are unnecessary. The approximation error of (5) as a function of different incident angle and frequency bins is illustrated in FIG. 1, where a small dual-microphone array with 1.7 cm microphone distance is assumed.

Using the obtained angular distance information, the directional-filter coefficients can be obtained by:

$$G(n,k)=\{0.5+0.5\cdot\cos[\beta\cdot\Delta\theta(n,k)]\}^{\alpha}, \tag{6}$$

where G(n,k) denotes the directional coefficient for frame n and subband k, which is multiplied to the output of the microphone signal processor (e.g. the output of a single-channel acoustic echo canceller). When the signal is from the desired direction, G(n,k) is approximately a unit value and the signal will be preserved. Otherwise, G (n,k) is low, and the sound is suppressed. $\beta$ is a parameter for beamwidth control. The higher $\beta$, the narrower beamwidth. $\beta$ can also be used for finding the tradeoff between the beamwidth and algorithm robustness. With lower $\beta$, the beam is wider, but in the meantime, the algorithm will be more robust against microphone phase mismatch and desired signal cancellation. $\alpha$ is a suppression factor. A higher $\alpha$ will lead to more aggressive attenuation of the signals from undesired directions. $\alpha$ can also be a variable parameter, which is automatically adjusted in the run time. For instance, on the one hand, when in-beam signals are detected, i.e., $\Delta\theta(n,k)\approx 0$ for many subbands at the same short-time frame, $\alpha$ can be set lower to avoid desired-signal cancelling. On the other hand, when in-beam signals are detected only for a few subbands, $\alpha$ can be set higher to suppress environmental interferences more aggressively.

In order to avoid music-tone artifacts in the filtered speech signals, time smoothing and frequency smoothing can be applied to all the obtained coefficients.

Time smoothing is normally implemented using a one-pole low-pass filter, with a variable time constant, e.g., when in-beam signals are detected, the time constant can be set lower (resulting in faster adaptation), otherwise, the time constant can be set higher (resulting in slower adaptation). In this way, a desired speech signal can be better protected, especially for weak speech onset and tail segments.

A simple frequency smoothing can be realized by just (only) limiting the differences between the adjacent subband coefficients below a given threshold (e.g., 12 dB). Other frequency smoothing techniques, which normally use psychoacoustic theories, can also be applied here.

The directional-filter coefficients can be applied to the output of the microphone signal processor for each short-time frame and subband, and the resultant spatial-filtered time-domain signal can be recovered using a synthesis filter bank.

The above process uses only microphone phase information. Therefore, it is robust against all sorts of microphone amplitude mismatches. This can be an advantage over most traditional beamforming methods, where both the phase and amplitude information are needed.

Improving Low-Frequency Robustness

Figure 2:
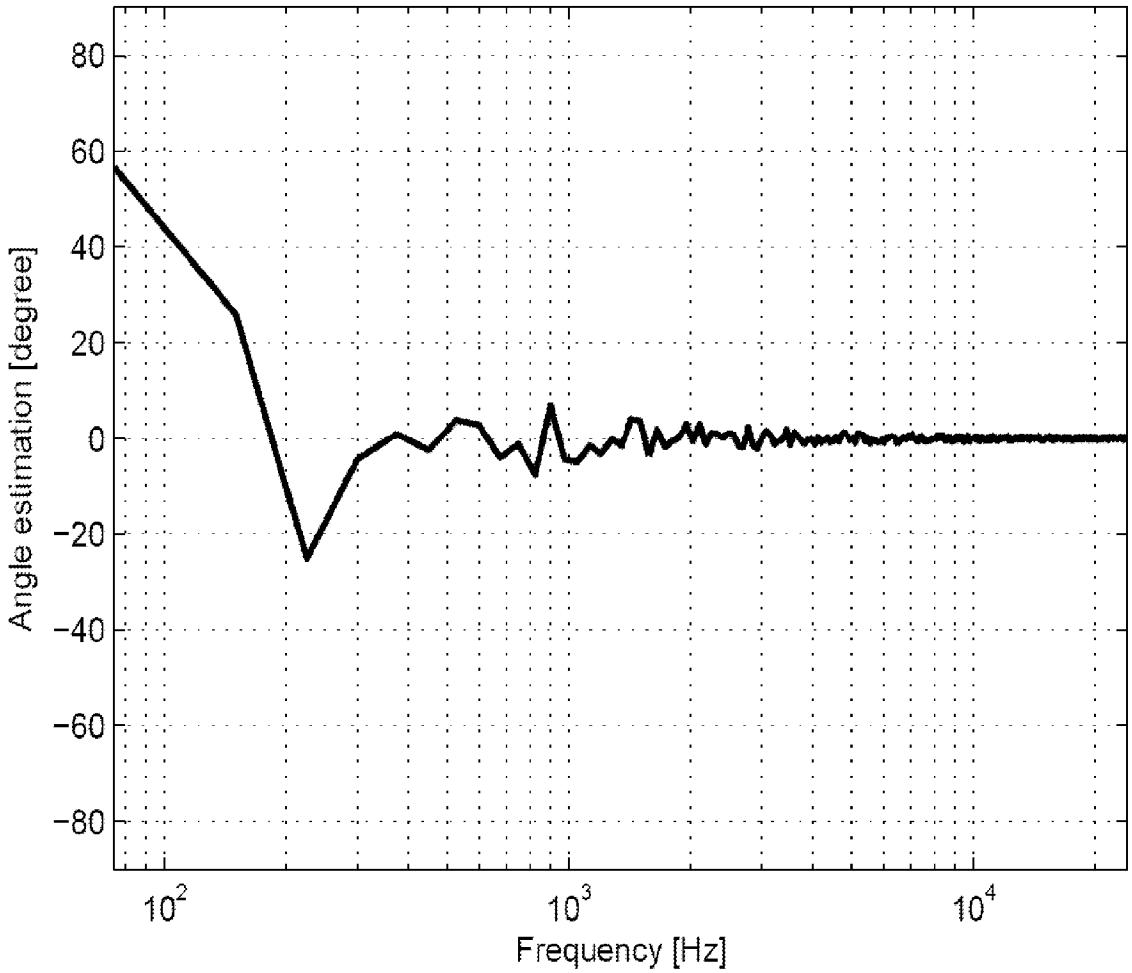
FIG. 2 illustrates angle estimation results of a 1.7 cm dual-microphone array with approximately a 2-degree phase mismatch for all frequency bins, where a true incident angle is 0 degrees.

In some personal speech communication devices, small arrays with very short microphone distance (e.g., 1.7 cm) are desired, since they require a small space and can be installed easily. However, from (5), it can be seen that, when microphone distances are very short and microphone phase mismatch exists, the angle estimation for low-frequency subbands may have large errors that lead to poor algorithm robustness, even though the phase mismatch at these subbands is very little. FIG. 2 illustrates angle estimation results of an exemplary 1.7 cm dual-microphone array with approximately a 2-degree phase mismatch for all frequency bins.

From an experimental study conducted in an office room environment, it was seen that, using a small array with an approximate 1.7 cm microphone distance, the angle estimation for frequency subbands of above 400 Hz are fairly accurate and robust against normal microphone phase mismatch. Therefore, to deal with a low-frequency poor robustness problem, an averaged filter coefficient is selected across frequency subbands of 2~3 kHz (the most robust frequency range for speech signals from experiments), to replace the coefficients of low-frequency subbands of 80~400 Hz.

$$G(n,k_{80\sim400\ Hz})=\overline{G(n,k_{2\sim3kHz})}, \tag{7}$$

where $\overline{(\bullet)}$ denotes an averaged value. Both subjective and objective evaluation results show that this approach improve the sound quality significantly. As the same time, since all filter coefficients are distributed between 0 and 1, such a technique does not cause any self-noise amplification issue, unlike many traditional superdirectional beamforming methods.

Reducing Spatial Aliasing

In theory, if a half of the wavelength of one subband sound signal is shorter than the microphone distance, spatial aliasing occurs, and the angle estimator may yield ambiguous results. If the microphone distance is around 2 cm, for instance, all subbands of frequency above 8 kHz will have a spatial aliasing issue. To address this problem, for each short-time frame, a global gain is calculated using the relatively robust subband coefficients, and this gain is applied to all the obtained subband coefficients, i.e., $$G(n,k)=G(n,k)\cdot\overline{G(n,k_{1\sim7kHz})}. \tag{8}$$

In this way, improper directional-filter coefficients resulting from an ambiguity in angle estimations at high frequencies can be effectively addressed.

A microphone array according to exemplary aspects has a small form factor containing 2 microphones, which can only require a small installation space and be easy to integrate. A signal processing algorithm can have a relatively low computational complexity, with a short convergence time. The microphone array can be more robust to a microphone sensitivity mismatch, compared to traditional beamforming techniques. The microphone array can be integrated into the existing echo canceller and noise suppressor in telepresence systems. The microphone array can also work for a wide frequency range and yield good audio quality, avoiding microphone self-noise amplification or desired signal cancelling at low-frequency subbands and reducing spatial aliasing at high-frequency subbands.

Figure 3A:
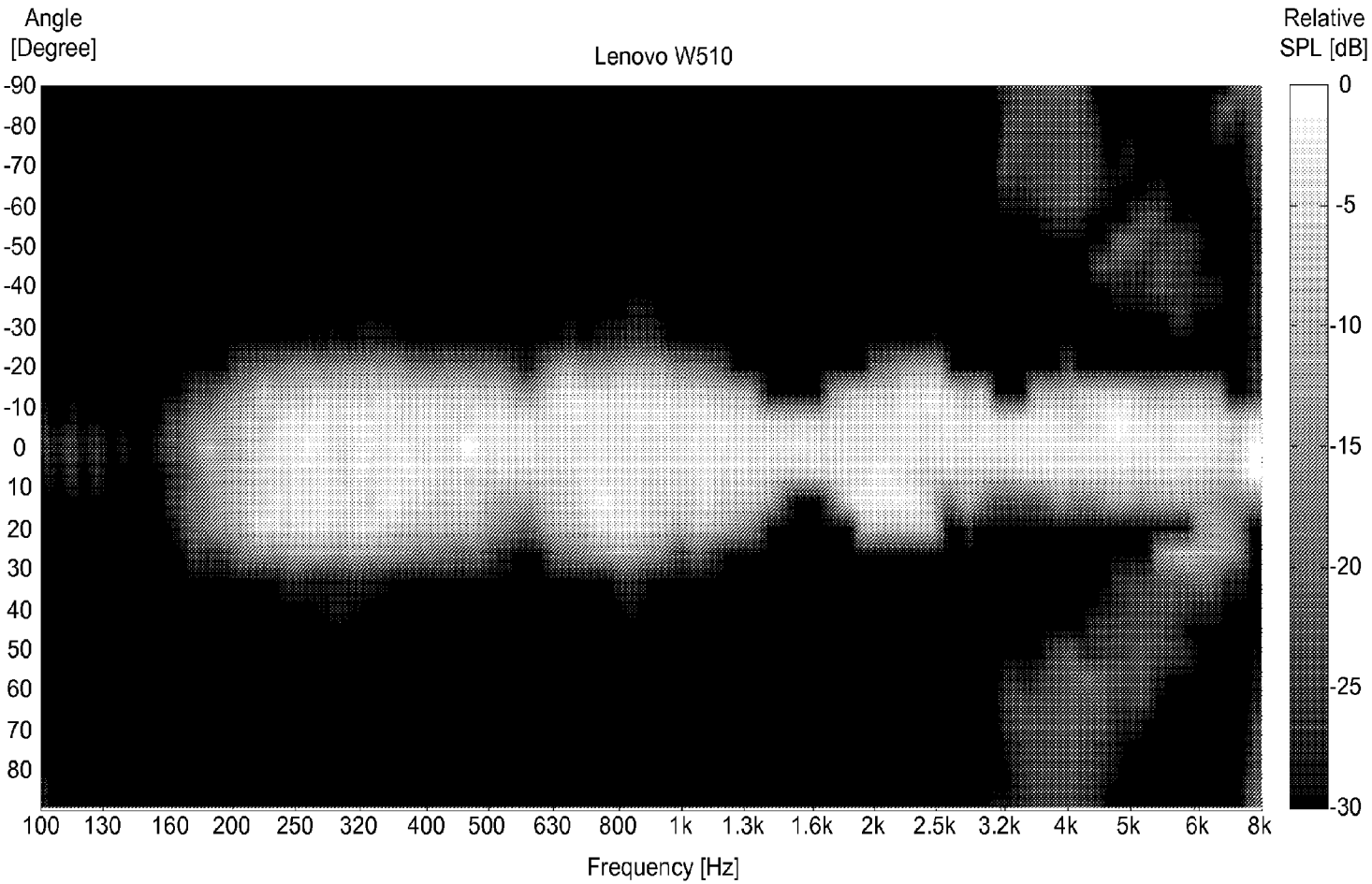
FIGS. 3A and 3B illustrate a directivity pattern comparison between a conventional ThinkPad W510 solution and a exemplary implementation.
Figure 3B:
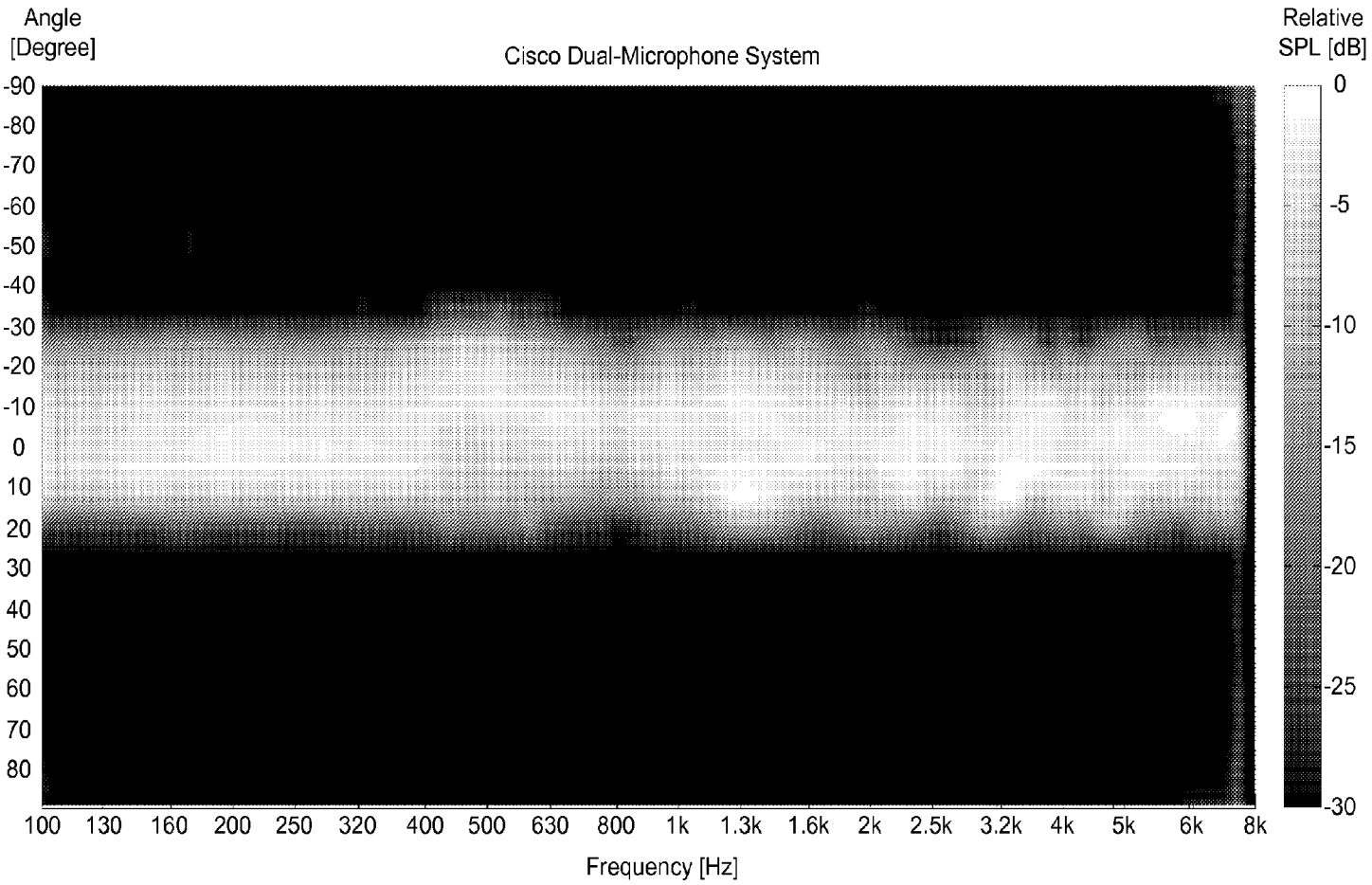

A real-time implementation and evaluation was performed with a digital signal processing system, which includes analog to digital signal converters and analyzers. Objective and subjective tests in both anechoic and reverberant environments show better sound quality than a ThinkPad W510 solution, with satisfactory interference suppression performance. FIGS. 3A and 3B illustrate a directivity pattern comparison between a ThinkPad W510 solution and the described process. FIG. 3A illustrates results from the ThinkPad W510 solution, whereas FIG. 3B illustrates results from the described process. The experiments were conducted in a semi-anechoic chamber. It can be seen that the technique described herein yields a wider frequency range and a more frequency-constant directivity pattern without low-frequency cut-off and high-frequency spatial aliasing, which is very desired in commercial products.

Based on the short-time frequency-domain signal model, a low-complexity but effective dual-microphone array interference suppression has been designed and implemented. A desired sound extraction and interference suppression performance is provided. In addition, the implementation is robust against low-frequency noise amplification and high-frequency spatial alias, which are inherent issues in traditional beamforming approaches.

Figure 4:
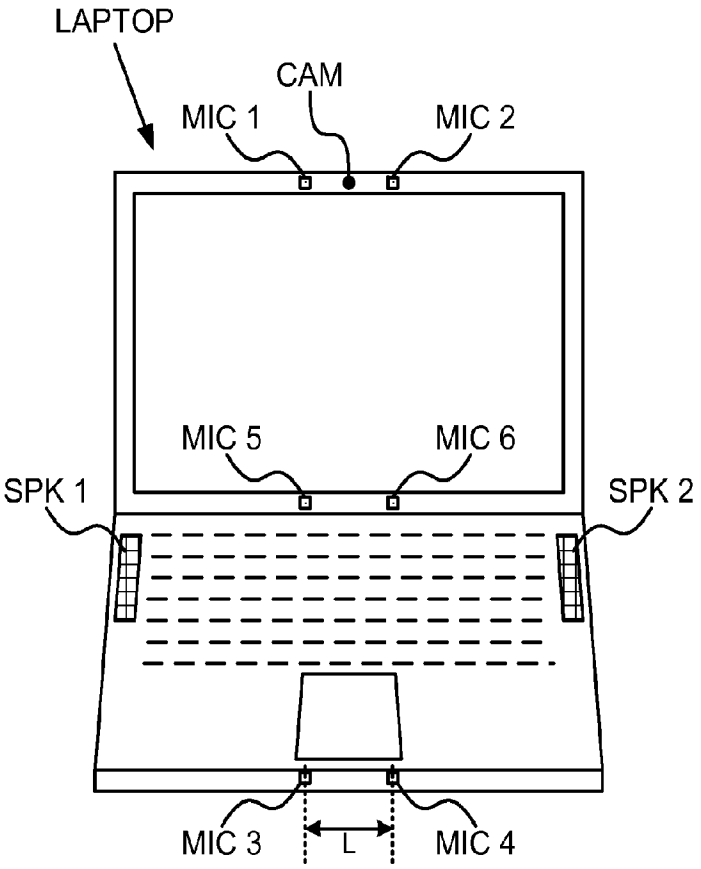
FIG. 4 schematically illustrates an exemplary processing system as a laptop personal computer.

An exemplary implementation of the aforementioned techniques and/or processes can be embodied in a laptop computer, such as that schematically illustrated in FIG. 4. The laptop computer includes computer hardware, including a central processing unit (CPU). The laptop computer includes a programmable audio section, which is a portion (i.e. a circuit) of the CPU specifically designed for audio processing. A discrete programmable audio processing circuit can also be provided. The processor(s) of the laptop computer can utilize various combinations of memory, including volatile and non-volatile memory, to execute algorithms and processes, and to provide programming storage for the processor(s).

The laptop computer can include a display, a keyboard, and a track pad. The laptop can include speakers (e.g., SPK 1 and SPK 2) for stereo audio reproduction (or audio reproduction of mono or more than two channel audio reproduction). Additional speakers can also be provided. The laptop can also include a pair of microphones. Exemplary pairs of microphones are shown in FIG. 4 as pair of MIC 1 and MIC 2, and as pair of MIC 3 and MIC 4. Microphones MIC 1 and MIC 2 are placed atop the display, whereas microphones MIC 3 and MIC 4 are placed below the track pad. A camera CAM is provided between microphones MIC 1 and MIC 2. Although one implementation involves utilizing only two microphones, such as one of the pair of MIC 1 and MIC 2, and the pair of MIC 3 and MIC 4, more than two microphones can be utilized for further optimization. Additionally, as shown as the pair of MIC 5 and MIC 6 in FIG. 4, the microphones can be placed below the display of a laptop computer. The shown pairs of microphones can also be provided in similar or corresponding positions of a desktop monitor or all-in-one computer. Although not shown in the illustrated implementations, a pair of microphones can also be provided off-center from a center of the display or elsewhere on the casing.

Figure 5:
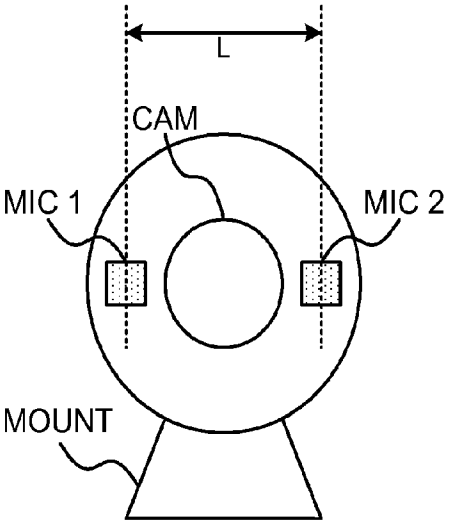
FIG. 5 schematically illustrates an exemplary processing system as a mountable camera.

FIG. 5 schematically illustrates an exemplary processing system as a mountable camera. The mountable cameras includes a camera CAM provided between microphones MIC 1 and MIC 2. The CAM, MIC 1 and MIC 2 can be provided in a casing atop a mount, which can be adapted to be secure to a top of a computer monitor or atop a desk, for example. A processing system (such as that discussed below) can be incorporated into the casing, such that a signal from the MIC 1 and MIC 2, as well as a signal from the CAM, can be transmitted wirelessly via a wireless network, or by a wired cable, such as a Universal Serial Bus (USB) cable. The algorithms discussed herein can be implemented within the mountable camera, or in a personal computer connected to the mountable camera.

The above-discussed microphones can be omnidirectional microphones, which are displaced by a distance L. The distance L can be 1.7 cm. The distance L is variable between 0.5 and 50 cm, and the distance L is preferably around or about 2 cm (e.g., between 1.5 and 2.4 cm).

Figure 6:
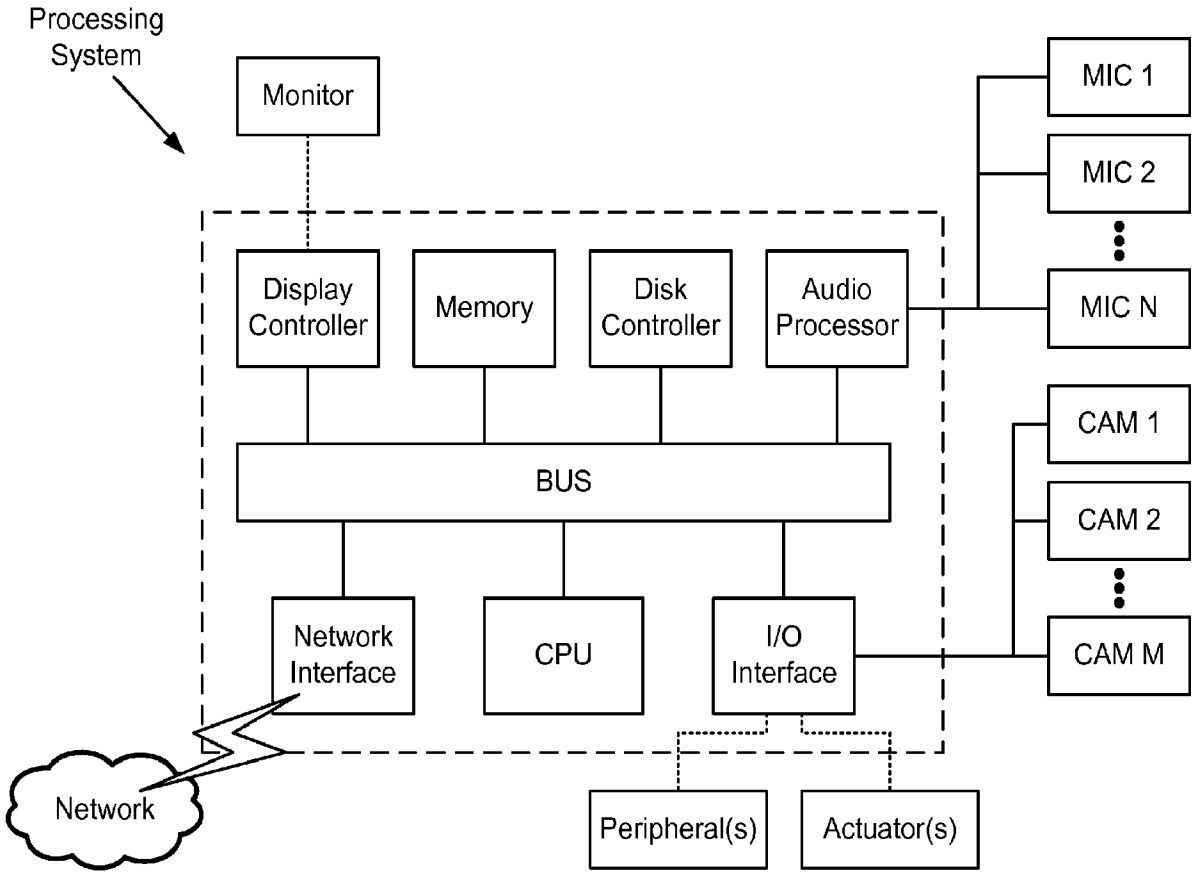
FIG. 6 schematically illustrates a processing system for a controller and/or a computer system.

FIG. 6 illustrates an exemplary processing system, and illustrates exemplary hardware found in a controller or computing system (such as a personal computer, i.e. a laptop or desktop computer) for implementing and/or executing the processes, algorithms and/or methods described in this disclosure. A microphone system and/or processing system in accordance with this disclosure can be implemented in a mobile device, such as a mobile phone, a digital voice recorder, a dictation machine, a speech-to-text device, a desktop computer screen, a tablet computer, and other consumer electronic devices.

As shown in FIG. 6, a processing system in accordance with this disclosure can be implemented using a microprocessor or its equivalent, such as a central processing unit (CPU) and/or at least one application specific processor ASP (not shown). The microprocessor is a circuit that utilizes a computer readable storage medium, such as a memory circuit (e.g., ROM, EPROM, EEPROM, flash memory, static memory, DRAM, SDRAM, and their equivalents), configured to control the microprocessor to perform and/or control the processes and systems of this disclosure. Other storage mediums can be controlled via a controller, such as a disk controller, which can controls a hard disk drive or optical disk drive.

The microprocessor or aspects thereof, in an alternate embodiment, can include or exclusively include a logic device for augmenting or fully implementing this disclosure. Such a logic device includes, but is not limited to, an application-specific integrated circuit (ASIC), a field programmable gate array (FPGA), a generic-array of logic (GAL), and their equivalents. The microprocessor can be a separate device or a single processing mechanism. Further, this disclosure can benefit form parallel processing capabilities of a multi-cored CPU.

In another aspect, results of processing in accordance with this disclosure can be displayed via a display controller to a monitor. The display controller would then preferably include at least one graphic processing unit, which can be provided by a plurality of graphics processing cores, for improved computational efficiency. Additionally, an I/O (input/output) interface is provided for inputting signals and/or data from microphones (MICS) 1, 2 . . . N and/or cameras (CAMS) 1, 2 . . . M, and for outputting control signals to one or more actuators to control, e.g., a directional alignment of one ore more of the microphones and/or cameras.

Further, as to other input devices, the same can be connected to the I/O interface as a peripheral. For example, a keyboard or a pointing device for controlling parameters of the various processes and algorithms of this disclosure can be connected to the I/O interface to provide additional functionality and configuration options, or control display characteristics. Moreover, the monitor can be provided with a touch-sensitive interface for providing a command/instruction interface.

The above-noted components can be coupled to a network, such as the Internet or a local intranet, via a network interface for the transmission or reception of data, including controllable parameters. A central BUS is provided to connect the above hardware components together and provides at least one path for digital communication there between.

Figure 7:
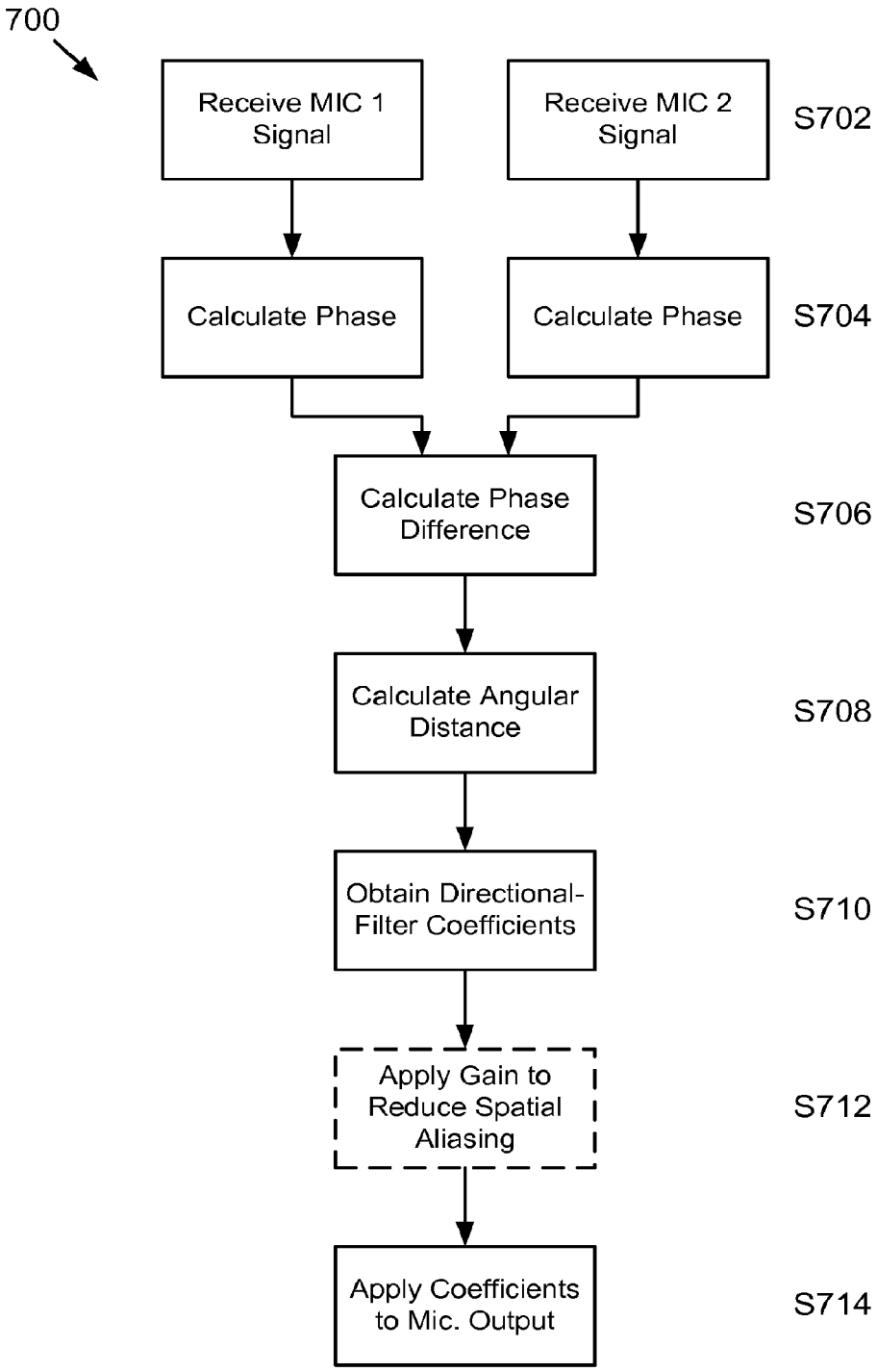
FIG. 7 is a flowchart illustrating an algorithm for suppressing spatial interference using a dual microphone array.

FIG. 7 illustrates an algorithm 700 executed by one or more processors or circuits. In FIG. 7, signals from microphones, such as MIC 1 and MIC 2, are received by a processing system, device, and/or circuit at S702. The phase of each of the signals is calculated at S704, and a phase difference is calculated therefrom at S706. See equations (1)-(3).

An angular distance is calculated at S708 based on the calculated phase different, and, at S710, directional-filter coefficients are obtained. See equations (4)-(6). Preferably, at S710 also includes (either performed concurrently, as a part of, or after obtaining the direction-filter coefficients) replacing low-frequency coefficients to improve low-frequency robustness. See equation (7). Also preferably, at S712, when a microphone distance is around 2 cm, all subbands of frequency above 8 kHz will have spatial aliasing issues. For each short-time frame, a global gain is calculated using the relatively robust subband coefficients, and is applied to all of the obtained subband coefficients at S712. See equation (8). The resulting coefficients are then applied to microphone outputs to achieve the above-discussed results.

Exemplary implementations have been described. Nonetheless, various modifications may be made without departing from the spirit and scope of this disclosure. For example, advantageous results may be achieved if the steps of the disclosed techniques were performed in a different sequence, if components in the disclosed systems were combined in a different manner, or if the components were replaced or supplemented by other components. The functions, processes and algorithms described herein may be performed in hardware or software executed by hardware, including computer processors and/or programmable circuits configured to execute program code and/or computer instructions to execute the functions, processes and algorithms described herein. Additionally, some implementations may be performed on modules or hardware not identical to those described. Accordingly, other implementations are within the scope that may be claimed.

The invention claimed is:

1. A controller comprising:

an interface configured to receive signals from a first microphone and a second microphone;

a signal processor configured to:

calculate a phase difference between a first signal from a first microphone and a second signal from a second microphone, given a distance between the first microphone and the second microphone, calculate directional-filter coefficients based on the phase difference, obtain a plurality of directional-filter coefficients, identify a subset of robust subband directional-filter coefficients from the plurality of directional-filter coefficients, calculate a gain using an average of the subset of robust subband directional-filter coefficients, and apply the gain to the plurality of directional-filter coefficients; and a memory configured to store the gain to the plurality of directional-filter coefficients.

2. The controller of claim 1, further comprising:

an actuator configured to receive signals from the interface to position the first microphone and the second microphone.

3. The controller of claim 1, wherein the signal processor is configured to calculate an angular distance between directions of arrival of a desired direction and at least one of the first signal and the second signal, and the direction-filter coefficient is based on the angular distance.

4. The controller of claim 1, further comprising:

a display configured to display the phase difference, the angular distance, the directional-filter coefficients or the global gain.

5. The controller of claim 1, wherein the subset of robust subband directional-filter coefficients are associated with a frequency greater that 1 kilohertz (kHz).

6. The controller of claim 1, wherein the signal processor is configured to filter undesired source signals from an output of the signal processor based on the plurality of directional-filter coefficients.

7. The controller of claim 6, wherein the signal processor is configured to replace at least one of the plurality of directional-filter coefficients of a first range of subbands with an average value of the directional-filter coefficients for a second range of subbands.

8. The controller of claim 1, wherein the first range of frequency subbands corresponds with less than 1 kHz, and the second range of frequency subbands corresponds with at least 2 kHz.

9. The controller of claim 1, wherein the signal processor is configured to calculate phase differences, between the first signal and second signal, for a particular short-time frame, across a plurality of discrete subbands of the first signal and the second signal.

10. The controller of claim 1, wherein the signal processor is configured to calculate angular distances, for a particular short-time frame, across a plurality of discrete subbands of the first signal and the second signal, by applying a trigonometric function to phase differences calculated by the signal processor.

11. The controller of claim 10, wherein the signal processor is configured to calculate direction-filter coefficients, for a particular short-time frame, across a plurality of discrete subbands of the first signal and second signal, by applying a trigonometric function to angular distances calculated by the signal processor.

12. A computer implemented method comprising:

receiving, by an interface coupled to a signal processor, a first signal from a first microphone and a second signal from a second microphone;

calculating, by the signal processor, a phase difference between the first signal and the second signal, given a distance between the first microphone and the second microphone;

calculating, by the signal processor, an angular distance between a desired capture direction and one or more directions of arrival of at least one of the first signal and the second signal based on the phase difference;

calculating, by the signal processor, a plurality of directional-filter coefficients based on the angular distance;

calculating, by the signal processor, a gain using an average of robust subband directional-filter coefficients from the plurality of directional-filter coefficients; and applying the average to the plurality of directional-filter coefficients.

13. The computer implemented method of claim 12, the method further comprising:

receiving, by an actuator, a control signal from the interface to control at least one of the first microphone and the second microphone.

14. The computer implemented method of claim 12, the method further comprising:

displaying, by a display, the phase difference, the angular distance, the directional-filter coefficients or the global gain.

15. The computer implemented method of claim 12, wherein the robust subband directional-filter coefficients corresponds with at least one frequency between 1 and 7 kHz.

16. The computer implemented method of claim 12, the method further comprising:

filtering, by the signal processor, undesired source signals from an output of the signal processor based on the plurality of directional-filter coefficients.

17. The computer implemented method of claim 16, the method further comprising:

replacing, by the signal processor, at least one of the directional-filter coefficients of a first range of subbands with an average value of the directional-filter coefficients for a second range of subbands.

18. The computer implemented method of claim 17, wherein the first range of frequency subbands corresponds to less than 1 kHz, and the second range of frequency subbands corresponds with at least 2 kHz.

19. The computer implemented method of claim 12, the method further comprising:

calculating, by the signal processor, phase differences, between the first and second microphone signals, for a particular short-time frame, across a plurality of discrete subbands of the first signal and the second signal.

20. A non-transitory computer readable medium including instructions stored in a memory and configured to be executed by a processor to:

calculate a phase difference between a first signal from a first microphone and a second signal from a second microphone based on a predefined distance of the first microphone and the second microphone;

calculate an angular distance between directions of arrival of source signals to the first and second microphones and a desired capture direction based on the phase difference;

calculate a plurality of directional-filter coefficients based on the angular distance;

calculate a gain using an average of robust subband directional-filter coefficients; and apply the average globally to each of the plurality of directional-filter coefficients.

* * * * *